US005908088A

United States Patent [19]

Webster et al.

[11] Patent Number: 5,908,088

[45] Date of Patent: Jun. 1, 1999

[54] HYDRAULIC DRIVE MECHANISM FOR A VERTICAL CONVEYOR

[75] Inventors: Mark R. Webster, Colgate; August R. Bergemann, Milwaukee; Gene M. Barth, West Bend, all of Wis.

[73] Assignee: Pflow Industries Inc., Milwaukee, Wis.

[21] Appl. No.: 08/773,687

[22] Filed: Dec. 27, 1996

[51] Int. Cl.[6] ..... B66F 9/04

[52] U.S. Cl. ..... 187/274; 187/213; 182/141; 254/89 H; 254/45

[58] Field of Search ..... 187/213, 215, 187/226; 254/89 H, 45; 182/141

[56] References Cited

U.S. PATENT DOCUMENTS

| | | | |
|---|---|---|---|
| 157,570 | 12/1874 | Birch . | |
| 2,319,126 | 5/1943 | Grote | 187/274 |
| 2,639,784 | 5/1953 | Strock . | |
| 2,655,115 | 10/1953 | Holdeman et al. . | |
| 3,613,834 | 10/1971 | Field | 187/274 |
| 3,650,356 | 3/1972 | Brown . | |
| 3,954,157 | 5/1976 | Atkey . | |
| 4,155,425 | 5/1979 | Allen et al. . | |
| 4,357,994 | 11/1982 | Hall . | |
| 4,363,380 | 12/1982 | Rued et al. . | |
| 4,703,835 | 11/1987 | Negrutsky et al. . | |
| 4,896,748 | 1/1990 | Mikkelsen et al. | 187/226 |
| 5,092,617 | 3/1992 | Jones, Jr. . | |
| 5,205,379 | 4/1993 | Pfleger . | |
| 5,371,993 | 12/1994 | Saito | 182/141 |
| 5,597,987 | 1/1997 | Gilliland et al. | 187/274 |
| 5,636,713 | 6/1997 | Perkins et al. | 187/274 |

FOREIGN PATENT DOCUMENTS

| | | | |
|---|---|---|---|
| 1932393 | 4/1970 | Germany | 187/274 |
| 703926 | 4/1966 | Italy | 187/274 |

*Primary Examiner*—Karen M. Young
*Assistant Examiner*—Thuy V. Tran
*Attorney, Agent, or Firm*—Andrus, Sceales, Starke & Sawall

[57] ABSTRACT

An improved hydraulic drive mechanism for a vertical conveyor. The conveyor comprises a pair of upright supports or columns and a carriage to support a load or cargo is guided for vertical movement on the columns. The drive mechanism includes a pair of first hydraulic cylinder units and a pair of second hydraulic cylinder units that preferably have twice the length of the first cylinder units. The first or shorter cylinder units are connected between a movable cross beam and the carriage, while the second cylinder units are connected between the movable beam and the upper end of the frame. At a lower level both the first and second cylinder units are in an extended condition, while at an upper level both cylinder units are retracted.

12 Claims, 3 Drawing Sheets

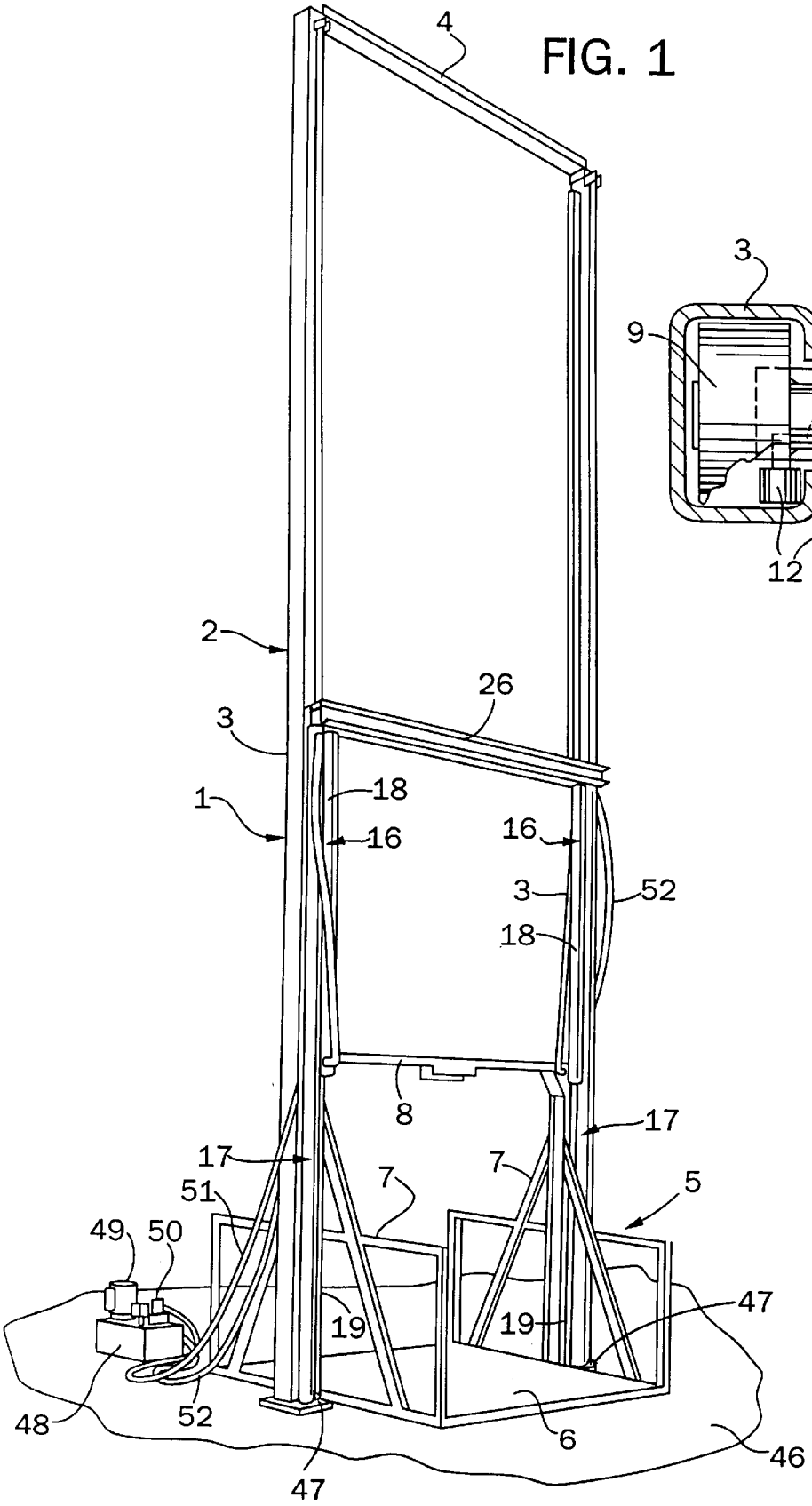
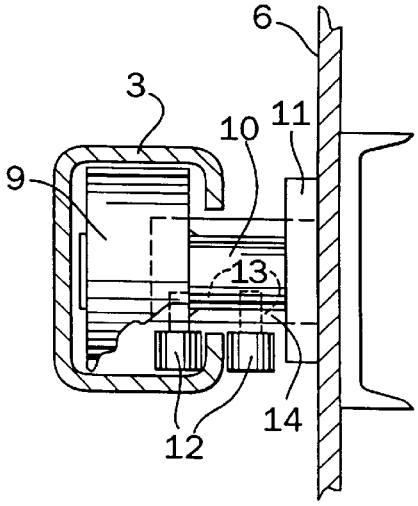
FIG. 4

FIG. 2
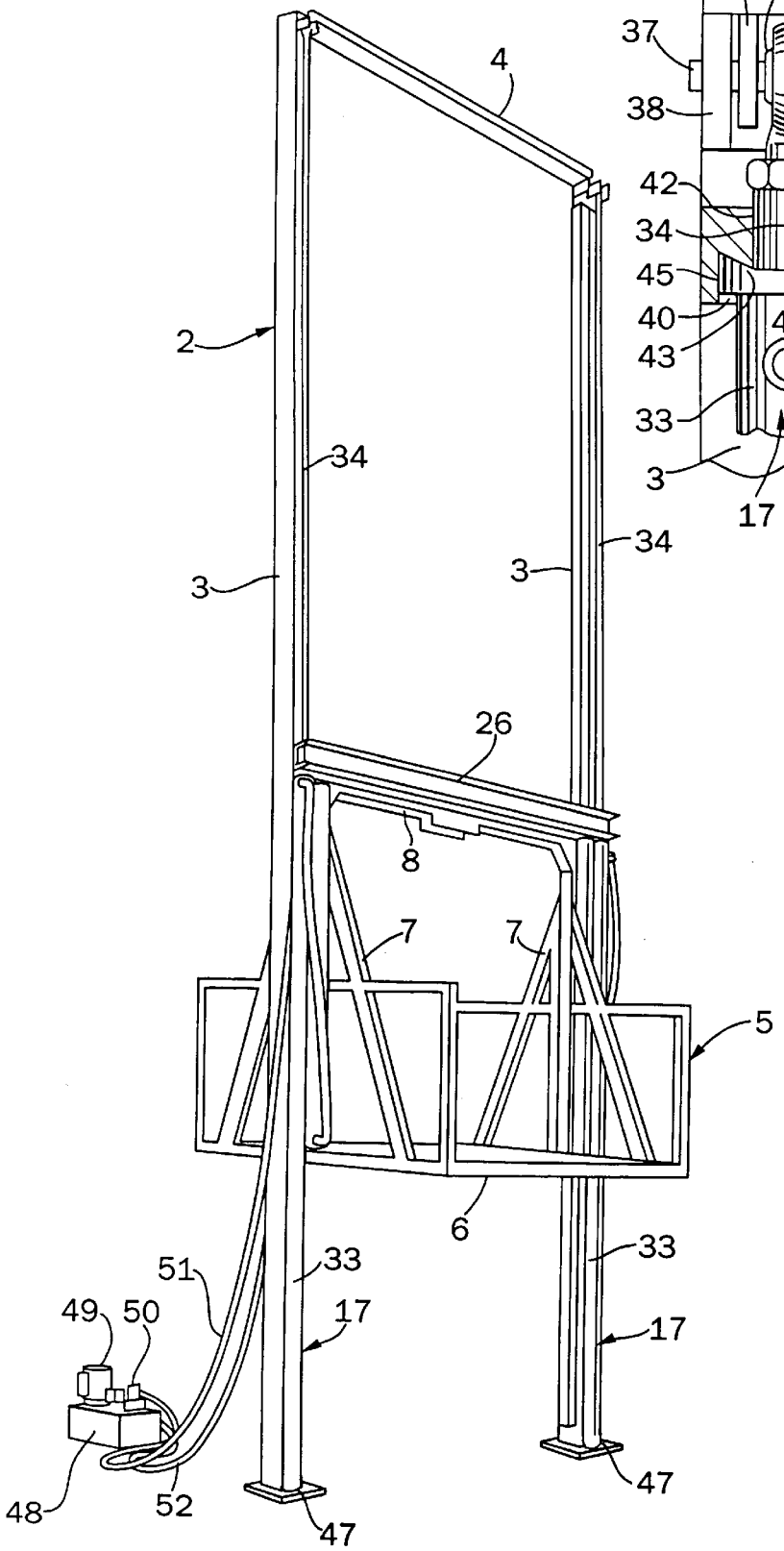
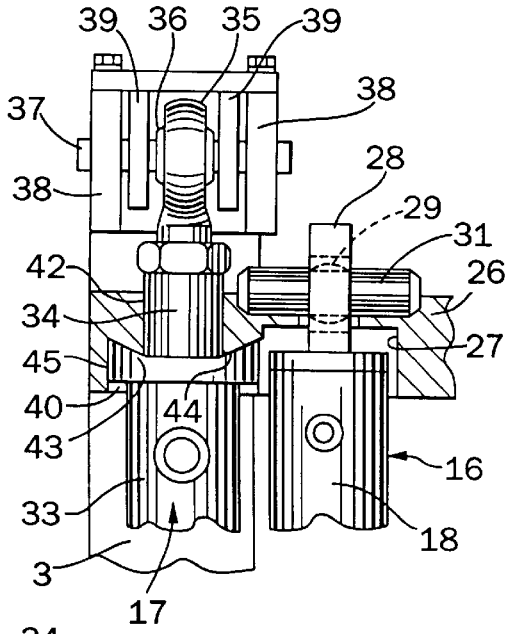
FIG. 5

HYDRAULIC DRIVE MECHANISM FOR A VERTICAL CONVEYOR

BACKGROUND OF THE INVENTION

Vertical conveyors are employed in warehouses, factories and the like to convey material or cargo between different vertical levels. The typical vertical conveyor includes a supporting structure or frame and a carriage, which is adapted to support cargo, is guided for vertical movement on the supporting structure.

In one type of vertical conveyor, the carriage is either straddled between two vertical columns of the frame or is cantilevered outward from the columns and is guided for vertical movement on the columns. The lifting of the carriage is accomplished through the use of two hydraulic cylinder units, each of which is mounted on one of the vertical columns. The piston rod of each cylinder unit is, in turn, connected to a flexible lift means consisting of either wire rope or roller chain, having one end connected to the carriage and the other end dead headed. A vertical conveyor of this type is described in U.S. Pat. No. 5,205,379. As described in the patent, each cylinder unit is affixed to the lower portion of its respective vertical column. The piston rod of each unit carries either a sheave adapted for wire rope or a sprocket adapted for roller chain. As the cylinder rod retracts, it pulls on either the roller chain or wire rope causing the carriage to elevate from the lower to the upper level. In typical designs, the wire rope is trained over four sheaves creating a four-part line so that each inch of piston rod travel produces four inches of carriage travel. In designs using roller chain, the chain is trained over two sprockets creating a two to one ratio of carriage movement to piston rod movement.

Other typical vertical conveyors use a pair of hydraulic cylinder units to elevate the carriage between levels. The cylinders are attached to each other and disposed so that one pistron rod pushes downward and one piston rod pushes upward against the carriage structure. With this design, care must be taken in design of the piston rod as the forces imposed by the weight of the carriage and the weight of the load being elevated impose a buckling force on the piston rods. As the cylinders are tied together, the piston rods are laterally offset from each other which results in a couple which puts considerable stress on the piston seals and packing flanges of the cylinder units. Because of the buckling and lateral forces on the cylinder units, this design is usually limited in capacity and vertical travel.

BRIEF SUMMARY OF THE INVENTION

The invention is directed to an improved hydraulic drive mechanism for a vertical conveyor. The conveyor includes a frame having a pair of spaced vertical columns, and a carriage that is adapted to support a cargo or load is mounted for vertical reciprocating movement on the vertical columns.

The hydraulic drive mechanism which is employed to raise the carriage from a lower level to an upper level consists of two pair of hydraulic cylinder units and in the preferred form of the invention, one cylinder unit of each pair has twice the length of the other cylinder unit of that pair. The base of each of the shorter length cylinder units is connected for pivotal movement to a cross beam that extends between the vertical columns, while the piston rod of each shorter length cylinder is connected through a pivotal connection to the carriage. The upper end of each longer cylinder unit is connected to the movable cross beam through a pivotal connection, while the piston rod of each longer cylinder unit is connected to the upper end of the frame.

With this construction, at the lower level, the piston rods of both the shorter and longer cylinder units are in the extended condition. To lift the carriage from the lower level to the upper level, hydraulic fluid is delivered to the cylinder units and the shorter cylinder units are preferably designed such that the shorter cylinder units will initially retracted to lift the carriage, followed by the retraction of the longer cylinder units. At the upper level, both the shorter and longer length cylinder units are in the retracted position.

With the construction of the invention, the piston rods of both the shorter and longer length cylinder units are retracted and under tension when the carriage is at the upper level, thus eliminating high bending forces that could be imparted to an extended piston rod in compression.

As one cylinder unit of each pair has a different length than the other cylinder unit of the that pair, preferably in a 2:1 length ratio, the vertical travel of the carriage is equal to three times the length of the shorter cylinder units.

As a feature of the invention, the piston rods and cylinders of all of the cylinder units are connected to the frame, carriage and movable cross beam through pivotal connections that permit universal movement, thus preventing lateral stress on the cylinders and minimizing wear on the pistons and piston rod seals, as well as minimizing binding of the piston rods during extension and retraction.

The hydraulic drive system of the invention also has advantages over drive systems utilizing a cable or chain in combination with a cylinder unit. As chains or cables are subjected to wear and possible breakage, a safety mechanism is normally incorporated which causes the carriage to grab the vertical columns in the event of breakage of the chain or cable. With the hydraulic drive system of the invention, standard velocity fuses can be employed to prevent free descent of the carriage in the event of a pressure loss in the hydraulic system, and velocity fuses are more reliable than the safety mechanisms commonly used with a chain or cable system.

Other objects and advantages will appear in the course of the following descriptions.

BRIEF DESCRIPTION OF THE DRAWINGS

The drawings illustrate the best mode presently contemplated of carrying out the invention.

In the drawings:

FIG. 1 is perspective view of the vertical conveyor of the invention with the carriage shown at a lower level;

FIG. 2 is a view similar to FIG. 1 showing the carriage in an intermediate level;

FIG. 4 is a horizontal section showing the connection of the carriage to a vertical support column;

FIG. 5 is an enlarged fragmentary side elevation with parts broken away in section showing the connection of the cylinder units to the movable cross beam.

DETAILED DESCRIPTION OF THE INVENTION

Figure 3:
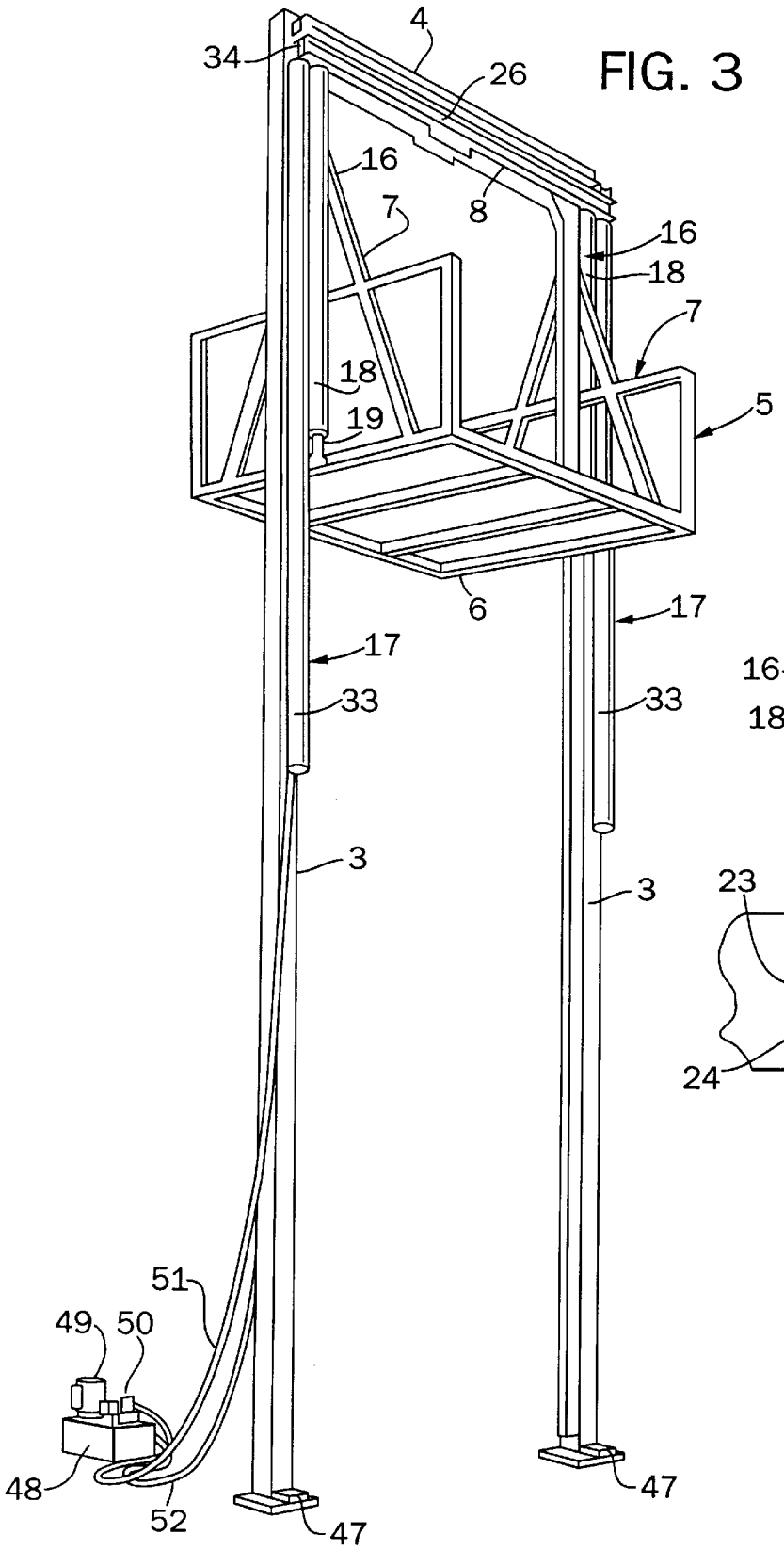
FIG. 3 is a view similar to FIG. 1 showing the carriage at an upper level.

FIGS. 1–3 illustrate a vertical reciprocating conveyor 1 that is adapted to move material or cargo between different vertical level such as, for example, a lower floor or level and an upper floor or level.

Conveyor 1 includes a frame or supporting structure 2 composed of a pair of spaced vertical columns or beams 3. The lower ends of columns 3 are supported on a foundation, while the upper ends of the columns are connected together by a cross-beam 4.

Mounted for movement on columns 3 is a carriage 5 that includes a generally flat platform 6 adapted to support a load or cargo. Carriage 5 also includes a pair of side frames 7 which extend upwardly from the sides of platform 6 and the upper ends of side frames 7 are connected together by a cross member 8. In practice, an open mesh enclosure extends upwardly from the periphery of platform 6 to contain the cargo, and a gate encloses an opening or doorway in the enclosure through which the cargo is loaded onto platform 6. For purposes for clarity the enclosure and gate are not illustrated in the patent drawings.

Each column 3 is generally C-shape in cross section and a wheel or roller 9 is journaled on shaft 10 and rides on the inner surface of the column. Shaft 10 projects outwardly from plate 11 secured to the side of platform 6. In addition, a pair of rollers 12 ride on opposite sides of a flange of each column 3, as illustrated in FIG. 4, and each roller 12 is journaled on a shaft 13 that projects laterally from a horizontal support plate 14. The inner end of each plate 15 is secured to the corresponding side of platform 6. Plate 14 can be located either above or beneath shaft 10 and wheel 9. As carriage 5 is moved vertically, wheels 9 will ride against the inner surface of the respective column 3, and rollers 12 ride against the inner flange of the column and prevent lateral displacement of the carriage with respect to the columns 3.

Figure 6:
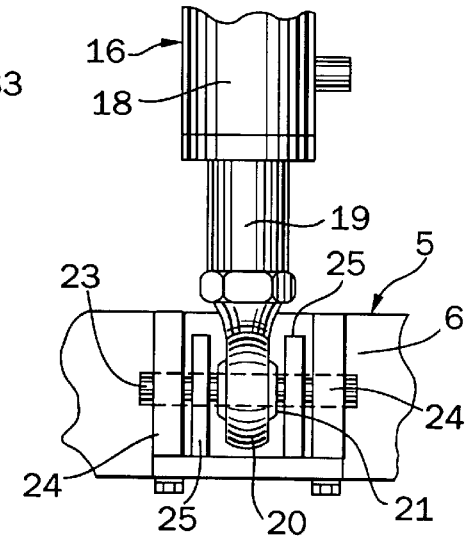
FIG. 6 is an enlarged fragmentary side elevation showing the connection of a shorter cylinder unit to the carriage.

To raise the carriage between the lower level and the upper level, two pair of hydraulic cylinder units 16 and 17 are utilized. In a preferred form of the invention, cylinder units 16 have approximately one-half the length of the cylinder units 17. Each cylinder unit 16 includes a cylinder 18 and a piston rod 19 which is slidable in cylinder 18. Piston rod 19 extends downwardly from the lower end of cylinder 18 and the end of each piston rod 19 carries an eye 20, as seen in FIG. 6. Mounted within a central opening in eye 20 is a bearing 21 having a generally spherical outer surface and a pin 23 is journaled within bearing 21. The ends of pin 23 are secured to lugs 24 which extend outwardly from the sides of platform 6. Spacers 25 are located between lugs 24 and the sides of bearing 21. With this construction, each piston rod 19 can pivot about the axis of pin 23 and can also pivot about the spherical outer surface of the bearing 21.

The upper or closed end of each cylinder 18 is pivotally connected to an end of a movable cross beam 26 which extends transversely across frame 2. Beam 26 is not directly connected to columns 3, but is carried by the cylinder units 16 and 17. As best shown in FIG. 5, the closed end of each cylinder 18 is received within a recess 27 in the end of beam 26, and an eye 28 mounted on the end of cylinder 18 projects upwardly through an opening in the beam and carries a bearing 29 that has a generally spherical outer surface Pin 31 is mounted within the central opening in bearing 29, and the ends of pin 31 are seated within semi-circular grooves 32 formed in the upper surface of beam 26. This construction also permits the cylinder 18 to pivot about the axis of pin 31, as well as pivoting on the outer spherical surface 30 of bearing 29.

Each of the longer cylinder units 17 includes a cylinder 33 and a piston rod 34 which projects upwardly from the cylinder, and is slidable within the cylinder. The outer or distal end of each piston rod 34 is pivotally connected to the upper end of the respective column 3, as best illustrated in FIG. 5. An eye 35 is connected to the end of piston rod 34 and carries a bearing 36 having a generally spherical outer surface. Pin 37 is journaled within bearing 36 and the ends of the pin are mounted on side members 38 that project outwardly from the upper end of column 3. In addition, spacers 39 are connected to column 3 and are located between lugs 38 and the sides of bearing 36. As previously described, this construction enables piston 34 to pivot about the axis of pin 37, as well as to pivot about the spherical outer surface of bearing 36.

The upper end of each cylinder 33 is connected to the end of movable cross beam 26, as illustrated in FIG. 5. The lower surface of beam 26 is provided with a recess 40 which connects with recess 27, and a hole 42 extends upwardly from recess 40 and receives the piston rod 34. The bottom of recess 40 is formed with a generally spherical surface 43 which mates with an complements a generally spherical surface 44 on cap 45 that is secured to the upper end of cylinder 33. The mating curved surfaces 43 and 44 permit the cylinder 33 to pivot in a universal manner relative to cross beam 26.

The lower closed end of each cylinder 33 is not secured to foundation 46, but in the extended condition, the lower end of each cylinder 33 will engage a resilient pad or cushion 47 on foundation 46. Engagement of cylinder 18 with pad 47 will prevent the piston of cylinder 33 from contacting the upper packing glands when the piston rod 34 of cylinder unit 17 is fully extended.

Cylinder units 16 and 17 are preferably single acting, in which hydraulic fluid is supplied to the cylinders to raise the carriage from the lower level to the upper level. Releasing the pressure in the hydraulic system will enable the carriage 5 to descend by gravity from the upper level to the lower level.

FIGS. 1–3 schematically illustrate the hydraulic system which includes a tank or reservoir 48 for the hydraulic fluid, a pump 49 for pressurizing the fluid and a valve mechanism 50. Pressurized fluid is delivered through lines 51 to each cylinder unit 16 and through lines 52 to the cylinder units 17.

FIG. 1 shows the carriage 5 at the lower level, and at this position, the cylinder units 16 and 17 are in the extended condition. To raise the carriage 5, the hydraulic system is actuated to supply pressurized hydraulic fluid to both cylinders 16 and 17. It is preferred that cylinder units 16 move to the fully retracted position before retraction of the longer cylinder units 17. To provide this sequential action, the piston rods 34 of the longer cylinder units 17 can have a larger diameter, so that the cylinder units 17 have a smaller displacement than cylinder units 16. As the shorter cylinder units 16 have a larger displacement, they will operate first to move the shorter cylinder units 16 to the fully retracted position before the longer cylinder units 17 begin to retract. FIG. 2 illustrates the position of the carriage with the shorter cylinder units 16 in the fully retracted position, and the longer cylinder units 17 fully extended.

FIG. 3 illustrates the carriage at the upper level, and in this position the cylinder units 16 and 17 are both in the fully retracted position and the movable beam 26 is located adjacent the top beam 4 of the frame.

To lower the carriage from the upper level to the lower level, operation of the hydraulic pump 49 is terminated, and the carriage will descend by gravity to the lower level, as shown in FIG. 1.

When the carriage is at the upper level, the cylinder units 16 and 17 are in a "pull mode". which is more stable than a "push mode". In a "push mode", the load, at the upper level, is supported by the extended piston rods with the result that there is considerable load on the piston seals and packaging glands of the cylinder units, as well as a potential for buckling failure of the extended piston rod.

As the cylinder units 16 and 17 are of unequal length, and preferably in a 2:1 ratio, the vertical travel will be equal to three times the length of the shorter cylinders 16. In practice, the length of the shorter cylinder unit 16 is approximately equal to the height of carriage 5, as illustrated best in FIGS. 2 and 3.

The pivotal or universal connections between the cylinder units 16 and 17 with movable beam 26, carriage 5 and cross beam 4 permits slight pivotal movement of the cylinders which insures concentric loading and minimizes stress on the seals and packing glands, thus substantially improving the service life of the cylinder units.

While the above description has shown the invention as applied to a vertical conveyor for transporting cargo, it is contemplated that the invention can also be used in conjunction with elevators that are intended to transport personnel and/or cargo. Thus, the term "vertical conveyor" as used in the specification and claims is intended to include any type of conveyor or elevator for moving cargo or personnel.

We claim:

1. A vertical conveyor, comprising a frame including a pair of spaced vertical supports, a carriage to carry a load and mounted for movement on said vertical supports in a path from a lower level to an upper level, and drive means for moving said carriage in said path, said drive means including a movable member mounted for vertical movement relative to said frame, a first hydraulic cylinder unit interconnecting said movable member and said carriage, a second hydraulic cylinder unit interconnecting the upper end of the frame and said movable member, said first and second cylinder units each having an extended position and a retracted position, both said first and second cylinder units being in said retracted position when said carriage is at said upper level.

2. The conveyor of claim 1, wherein said first and second cylinder units are of different lengths.

3. The conveyor of claim 2, wherein said second cylinder unit has a length approximately twice the length of the first cylinder unit.

4. The conveyor of claim 1, wherein said first cylinder unit includes a first cylinder and a first piston rod slidable relative to said first cylinder, said first piston rod being connected to said carriage and said first cylinder being connected to said movable member, said second cylinder unit comprising a second cylinder and a second piston rod slidable relative to said second cylinder, said second cylinder being connected to said movable member and said second piston rod being connected to said frame.

5. The conveyor of claim 4, and including first pivot means for pivotally connecting said first cylinder to said movable member and second pivot means for pivotally connecting said second cylinder to said movable member.

6. The conveyor of claim 4, wherein said movable member comprises a horizontal beam extending in a direction between said vertical supports.

7. A vertical conveyor, comprising a frame including a pair of spaced vertical supports, a carriage mounted for movement on said vertical supports from a lower level to an upper level, a cross beam extending in a direction between said vertical supports and movable vertically relative to said frame, a pair of first hydraulic cylinder units each interconnecting said cross beam with a side of said carriage, and a pair of second hydraulic cylinder units each interconnecting said cross beam and an upper end of said frame, said first and second cylinder units each having an extended position and a retracted position, both said first and second cylinder units being in said extended position when said carriage is at said lower level and being in said retracted position when said carriage is at said upper level.

8. The conveyor of claim 7, wherein said first cylinder unit comprises a first cylinder and a first piston rod slidable in said first cylinder, said first piston rod being pivotally connected to said carriage and said first cylinder being pivotally connected to said cross beam, said second cylinder unit comprising a second cylinder and a second piston rod slidable in said second cylinder, said second cylinder being pivotally connected to said cross beam and said second piston rod being pivotally connected to said upper end of the frame.

9. A vertical conveyor, comprising a frame including a pair of spaced vertical supports, a carriage mounted for movement on said vertical supports from a lower level to an upper level, a cross beam extending in a direction between said vertical supports and movable vertically relative to said frame, a pair of first hydraulic cylinder units each interconnecting said cross beam with a side of said carriage, and a pair of second hydraulic cylinder units each interconnecting said cross beam and an upper end of said frame, said first and second cylinder units each having an extended position and a retracted position, both said first and second cylinder units being in said extended position when said carriage is at said lower level and being in said retracted position when said carriage is at said upper level, each first cylinder unit including a first cylinder having a base and an outer end and further including a first piston rod slidable in said first cylinder and projecting from said outer end, the base of said first cylinder being pivotally connected to said cross beam and said first piston rod being pivotally connected to said carriage, each second cylinder unit including a second cylinder having a base and an outer end and further including a second piston rod slidable in said second cylinder and projecting from the outer end of said second cylinder, the outer end of said second cylinder being pivotally connected to said cross beam and said second piston rod being pivotally connected to the upper end of said frame.

10. The conveyor of claim 9, wherein said frame also includes an upper cross beam connected between the upper ends of said vertical supports, said second piston rod being pivotally connected to said upper cross beam.

11. The conveyor of claim 10, wherein the pivotal connection between the base of said first cylinder and said cross beam is constructed and arranged to permit said first cylinder to pivot universally with respect to said cross beam.

12. The conveyor of claim 10, wherein the pivotal connection between said second cylinder and said cross beam is constructed and arranged to permit said second cylinder to pivot universally relative to said cross beam.

* * * * *